United States Patent [19]

Colodner et al.

[11] Patent Number: 4,924,604

[45] Date of Patent: May 15, 1990

[54] DRYING DEVICE FOR GARMENTS

[75] Inventors: Jesse L. Colodner, Pearl River, N.Y.; Irving Portnoy, 14 Eisenhower Dr., Yonkers, N.Y. 10710

[73] Assignee: Irving Portnoy, Yonkers, N.Y.

[21] Appl. No.: 1,142

[22] Filed: Jan. 7, 1987

[51] Int. Cl.[5] ..... F26B 13/00

[52] U.S. Cl. ..... 34/151; 34/240; 219/536

[58] Field of Search ..... 34/148, 151, 200, 237, 34/239, 240; 211/181, 26, 35; 219/444, 467, 536; 248/231.9, 351; 439/527, 529, 530

[56] References Cited

U.S. PATENT DOCUMENTS

| | | | |
|---|---|---|---|
| 210,714 | 12/1878 | Sheeder | 34/148 |
| 1,143,536 | 6/1915 | Goodridge | 439/529 |
| 1,805,988 | 5/1931 | Kraft | 439/530 |
| 2,105,573 | 1/1938 | Wilson | 439/530 |
| 2,567,434 | 9/1951 | Hoskings | 34/240 |
| 2,588,989 | 3/1952 | Rodenburg et al. | 34/151 |
| 3,781,757 | 12/1973 | Barnes | 219/536 |
| 4,094,076 | 6/1978 | Baslow | 34/151 |

FOREIGN PATENT DOCUMENTS

| | | | |
|---|---|---|---|
| 2432064 | 3/1980 | France | 34/240 |

*Primary Examiner*—Harry B. Tanner

[57] ABSTRACT

A drying device for garments or other articles consists primarily of a frame composed of a pair of tubular heating elements, which support the garment or other article that is to be dried, and a thermostat is also included in the circuit of the heating elements for preventing the elements from becoming too hot. The device further includes a control box with a switch and an indication light, and prongs extend from the control box for plugging the device into an electrical outlet in a wall.

3 Claims, 2 Drawing Sheets

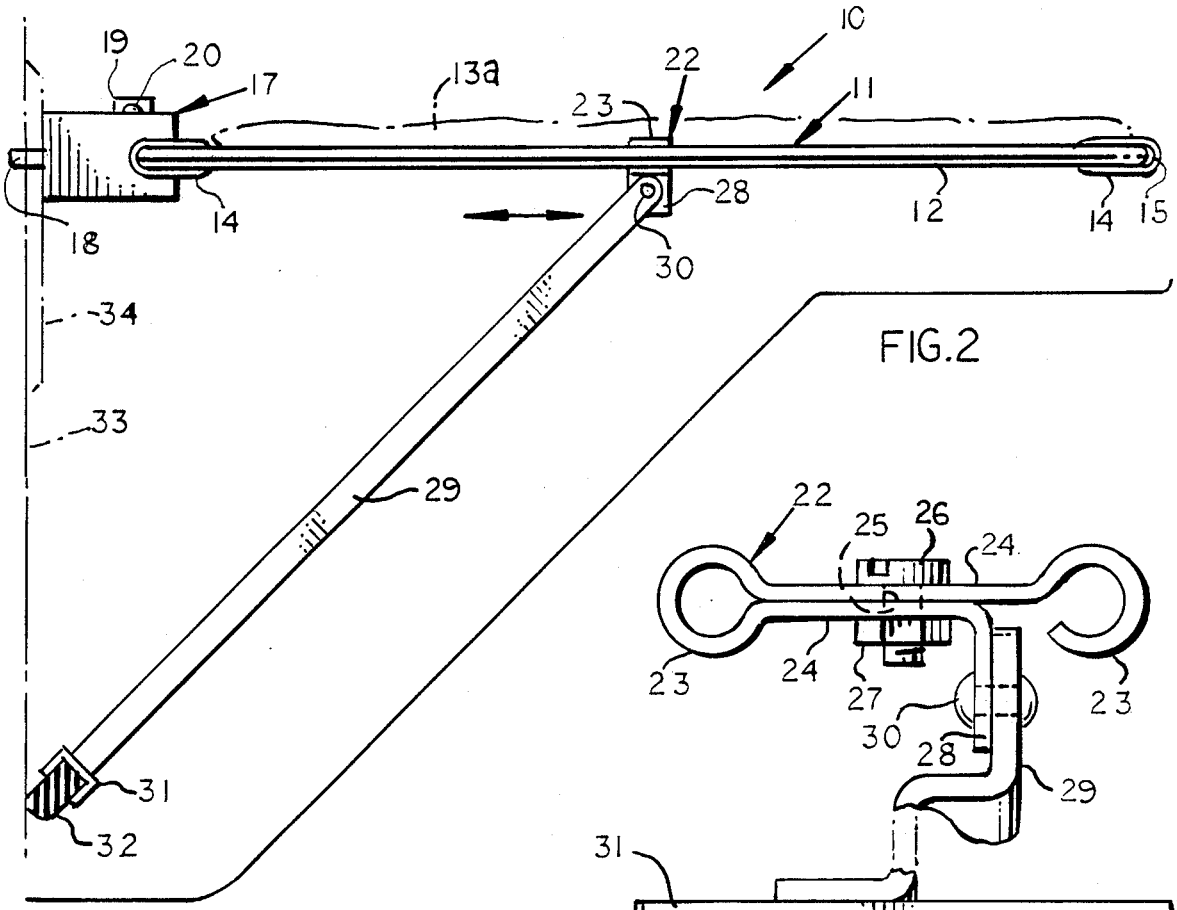
FIG.2
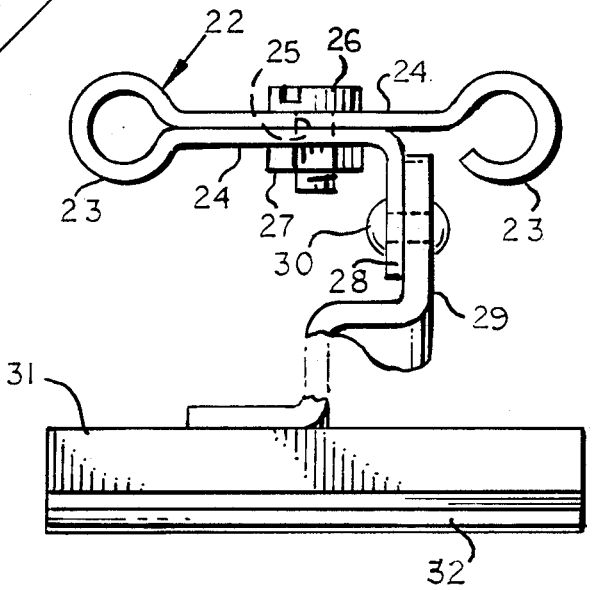
FIG.3
FIG.4
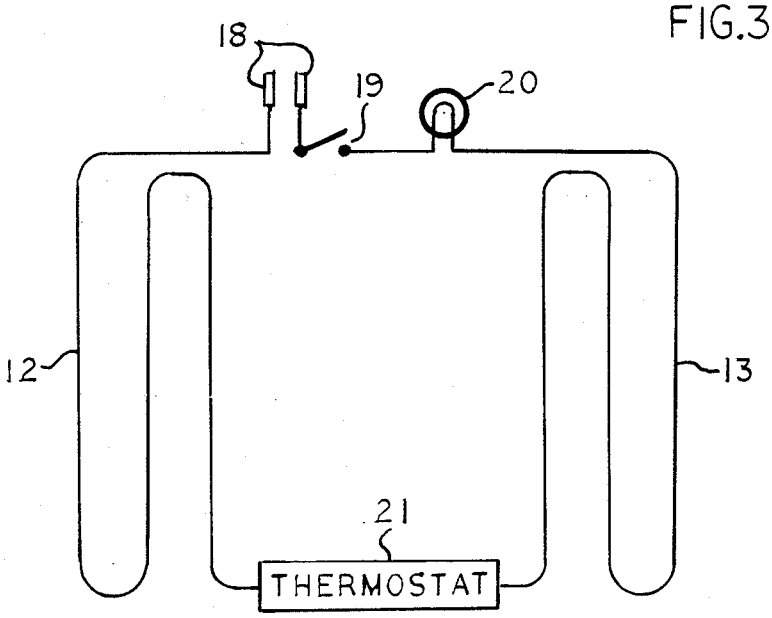

DRYING DEVICE FOR GARMENTS

BACKGROUND OF THE INVENTION

1. Field of the Invention

This invention relates to electrical dryers, and more particularly, to a drying device for garments.

2. Description of Prior Art

Dryers for many purposes are known in the art, and are of many types. The drying device in accordance with the present invention, is particularly adaptable for use in residences for drying wet articles after they have been washed, and the device is electrically operated.

The principal object of this invention is to provide a drying device for garments, which will be unique and novel, in that it will readily plug into a wall outlet receptacle in one's apartment or other type residence, when a person needs the article soon after washing same.

Another object of this invention is to provide a drying device for garments, which will be of such design, as to employ heating element means in the form of an open support frame that will support the garment or article while it is being dried, and thermostat means is included in the structure for controlling the heat, so as to prevent scorching or burning the garment while it is being dried thereon.

Another object of this invention is to provide a drying device for garments, which will be of such design, as to be foldable for compact storage, and it will include brace support means for the frame that comprises a pair of heating elements.

A further object of this invention is to provide a drying device for garments, which will also be attractive in appearance.

SUMMARY OF THE INVENTION

A drying device for garments, comprising a frame of a pair of tubular heating elements that are secured to a control box having an on-off switch and pilot light for indication means. The pair of heating elements are also secured to each other by a tubular portion and prongs are provided on the control box for plugging the device into a wall outlet receptacle. The frame of heating elements further serve as support means for the article or garment being dried, and an adjustable support support brace is also provided for solid support of the pair of heating elements against the wall containing the outlet receptacle.

DESCRIPTION OF FIGURES

FIG. 2 is a side view of FIG. 1, shown in elevation and illustrating an article thereon, in phantom;

FIG. 3 is enlarged fragmentary front view of the brace clamp and brace rod combination, shown in elevation and removed from the heating elements of the invention, and FIG. 4 is a schematic wiring diagram of the invention.

DETAILED DESCRIPTION

Figure 1:
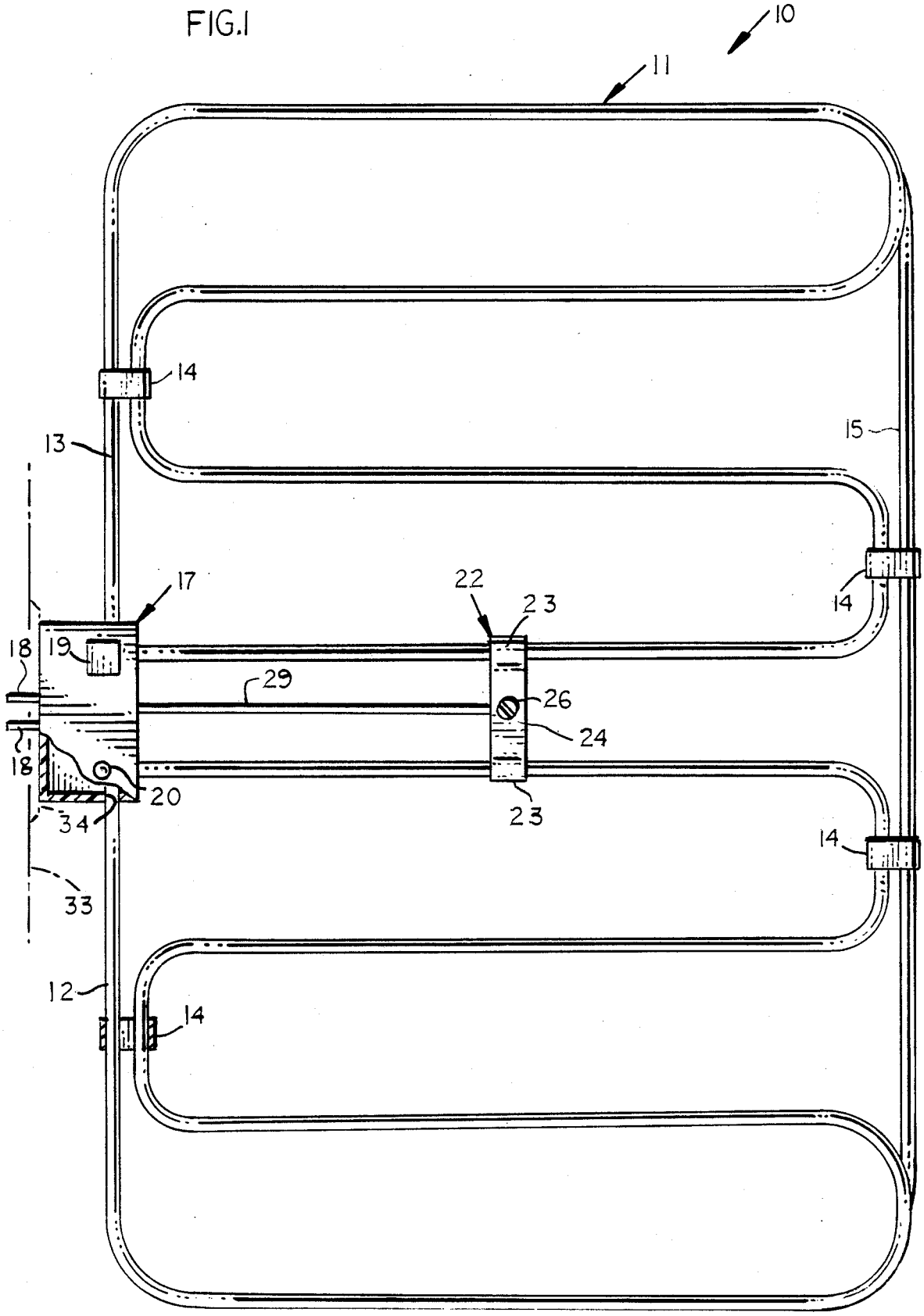
FIG. 1 is a top plan view of the present invention, shown partly in section and illustrating a wall outlet receptacle in phantom.

Accordingly, a device 10 is shown to include a frame 11 composed of a pair of tubular heating elements 12 and 13 having clamps 14 thereon, and a longitudinal side tube 15 is fixedly secured in a suitable manner, to both heating elements, 12 and 13 at both ends. A pair of the clamps 14 also engage tube 15 and the elements 12 and 13, providing extra longitudinal rigidity to the structure or frame 11 formed by the heating elements 12 and 13, so as to safely support an article 13*a* that is to be quickly dried, as is illustrated in FIG. 2 of the drawings. The front ends of the heating elements 12 and 13, are suitably secured within side openings 16 through control box 17, which is preferably fabricated of a suitable plastic, and the heating elements 12 and 13 are secured to prongs 18 through on-off switch 19, indication or pilot lamp 20, and a thermostat 21, the thermostat 21 being provided to regulate the temperature of the heating elements 12 and 13, so as to prevent scorching or burning the article 13*a* when it is being dried by device 10.

A brace clamp 22 includes eye portions 23 formed in its flat portions 24, which slidingly engage with the outer peripheral surfaces of both heating elements 12 and 13 at the center portion of the frame 11, and an opening 25 through flat portions 24, receives a screw fastener 26 that holds brace clamp 22 tight on the elements 12 and 13, by means of the nut fastener 27 received thereon. The bottom flat portion 25 of clamp 22 includes a downwardly formed lip 28 that engages with one end of a pivotal brace rod 29, and brace rod 29 is pivotally secured to lip 28 by a rivet fastener 30. The opposite or lower end of brace rod is fixedly secured to outside of the base portion of a channel member 31. A rubber strip 32 is frictionally engaging with wall 33 having an electrical outlet receptacle 34 therein, and strip 32 prevents brace rod 29 from moving on wall 33, thus, providing maximum support for frame 11, so as to prevent device 10 from falling under the weight of the article or articles 13*a*.

In use, the control box 17 is held in user's hand and the prongs 18 are pushed into the openings provided in the outlet receptacle 34 on wall 33. The brace rod 29 is then pivoted forward and upward until the rubber strip 32 firmly engages with the wall 33 under the receptacle 34. The switch 19 is then pushed to its on position for closing the circuit of heating elements 12 and 13, which will be indicated by the pilot lamp 20. The article or articles 13*a* are then placed on the top of the frame 11, where they will dry in a short time. Where necessary, the brace clamp 22 may be urged forward or rearward as desired, by loosening the screw fastener 25.

While various changes may be made in the detailed construction, such changes will be within the spirit and scope of the present invention, as defined by the appended claims.

What we claim is:

1. A garment drying device comprising an electrically heated garment support frame, a control box secured to said frame, and a brace rod to support said frame against a wall having an electrical wall outlet receptacle disposed therein;

said garment support frame comprising a pair of heating elements being coupled electrically in series and fixedly secured to a pair of prongs projecting from and fixedly secured to said control box, said prongs being detachably receivable in said wall outlet receptacle;

the end of said brace rod is disposed adjacent to said wall having a channel member fixedly attached thereto, said channel member including a rubber strip disposed therein which frictionally engages said wall to hold said device in place;

the end of said brace rod that is disposed adjacent to the heating elements of said device being pivotally attached thereto by means of a brace clamp, said brace clamp being attached to said heating element in slideably engagement therewith, said brace clamp being adjustably secured to said heating elements by screw fastener means.

2. A garment drying device as described in claim 1 including longitudinal side tubes disposed at the proximal and distal ends of said drying device in substantially parallel relation to said wall, said longitudinal side tubes being fixedly secured to the support frame of said drying device thereby providing additional rigidity for said garment support frame.

3. A garment drying device comprising an electrically heated garment support frame, a control box secured to said frame, and a brace rod to support said frame against a wall having an electrical wall outlet receptacle disposed therein;

said garment support frame comprising a pair of heating elements being coupled electrically in series and fixedly secured to a pair of prongs projecting from and fixedly secured to said control box, said prongs being detachably receivable in said wall outlet receptacle;

the end of said brace rod that is disposed adjacent to said wall having a channel member fixedly attached thereto, said channel member including a rubber strip disposed therein frictionally engages said wall to hold said device in place;

the end of said brace rod that is disposed adjacent to the heating elements of said device being pivotally attached thereto by means of a brace clamp, said brace clamp being attached to said heating element in slideably engagement therewith and said brace clamp being pivotally attached to said brace rod by fastener means transversely disposed through said brace rod and lip portion of said brace clamp, said brace clamp being adjustably secured to said heating elements by screw fastener means.

said garment drying device including longitudinal side tubes disposed at the proximal and distal ends of said drying device in substantially parallel relation to said wall, said longitudinal side tubes being fixedly secured to the support frame of said drying device by clamp fastener means thereby providing additional rigidity for said garment support frame.

* * * * *